United States Patent [19]

Korth

[11] Patent Number: 4,624,371

[45] Date of Patent: Nov. 25, 1986

[54] SECURITY CLOTHES-STAND

[75] Inventor: Bernd Korth, Weil am Rhein, Fed. Rep. of Germany

[73] Assignee: Protoned B.V., Amsterdam, Netherlands

[21] Appl. No.: 659,642

[22] Filed: Oct. 11, 1984

[30] Foreign Application Priority Data

Oct. 27, 1983 [CH] Switzerland ..... 5825/83

[51] Int. Cl.[4] ..... A47F 5/00

[52] U.S. Cl. ..... 211/4; 70/59; 248/408

[58] Field of Search ..... 211/4, 163; 248/551, 248/407, 408, 409, 221.3; 403/109, 319, 315; 70/58, 59, 62

[56] References Cited

U.S. PATENT DOCUMENTS

| | | | |
|---|---|---|---|
| 844,431 | 2/1907 | Wehagen | 211/70 X |
| 1,591,110 | 7/1926 | Willson | 248/408 X |
| 3,512,832 | 5/1970 | Kage | 248/408 X |
| 3,554,585 | 1/1971 | Sorenson | 248/408 X |
| 4,201,398 | 5/1980 | Meier | 70/59 X |

FOREIGN PATENT DOCUMENTS

| | | | |
|---|---|---|---|
| 2512139 | 10/1975 | Fed. Rep. of Germany | 211/4 |

*Primary Examiner*—Robert W. Gibson, Jr.
*Attorney, Agent, or Firm*—Ladas & Parry

[57] ABSTRACT

The security clothes-stand contains a number of holding rods (4) which are retained in a supporting device (3') and on the top end of which can be mounted a clothes-hanger (7) for receiving an article of clothing to be presented. The holding rods (4) essentially consist of a base tube (10) which is connected rigidly to the supporting device (3') and on which a casing tube (11) is rotatably mounted. The casing tube (11) carries at its top end a lock attachment (14) which contains a snap-in catch (15) designed for the releasable retention of the clothes-hanger (7). A holding member (7,5) of the clothes-hanger (7) can be inserted into a receiving orifice in the snap-in catch (15) and can be removed from the lock attachment (14) only after the catch (15) in the latter has been released.

5 Claims, 4 Drawing Figures

SECURITY CLOTHES-STAND

Figure 1:
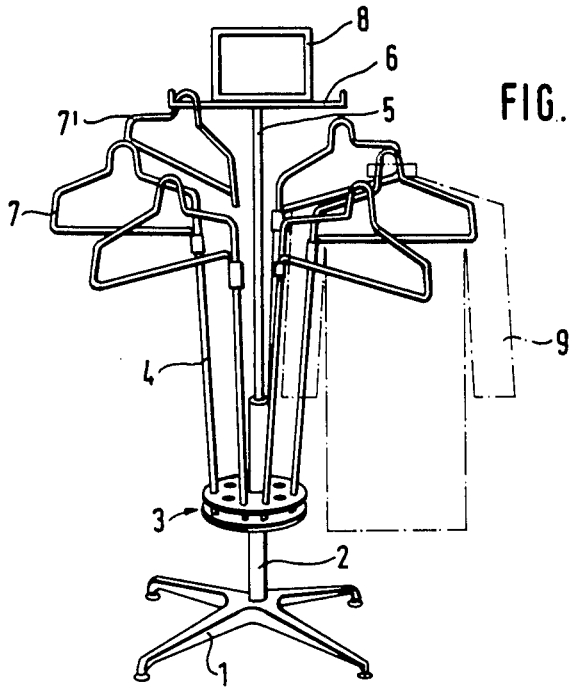

The invention relates to a security clothes-stand according to the pre-characterizing clause of patent claim 1. In particular, it relates to a clothes-stand to which relatively expensive articles of clothing with or without sleeves can be attached for presentation purposes in sales rooms of department stores and big stores, so as to be safeguarded against theft.

To make it easier to select articles of clothing, it is customary to attach a relatively large number of these to a single clothes-stand. If individual articles of clothing are removed, for example for the purpose of trying them on, and/or some of these articles of clothing are sold, possibly by several sales assistants, an ambiguous situation can arise as a result, and this favors theft which is difficult to discover, especially when several customers are present. Similar situations can also arise when, for example, the sales personnel can easily be diverted as a result of an overload of work and the merchandise offered is, for example, fur coats and such like articles of clothing.

The object of the invention is to propose a clothes-stand of the type mentioned, on which the individual articles of clothing are safeguarded against unauthorized removal from the clothes-stand. It should be possible to release the safety device for the article of clothing by a simple unlocking means. Furthermore, it should be easy to insert into the clothes-stand and be pivotable in the stand together with its supporting member.

This object is achieved by means of the characterizing features of patent claim 1. Embodiments of these emerge from the dependent claims.

Figure 1A:
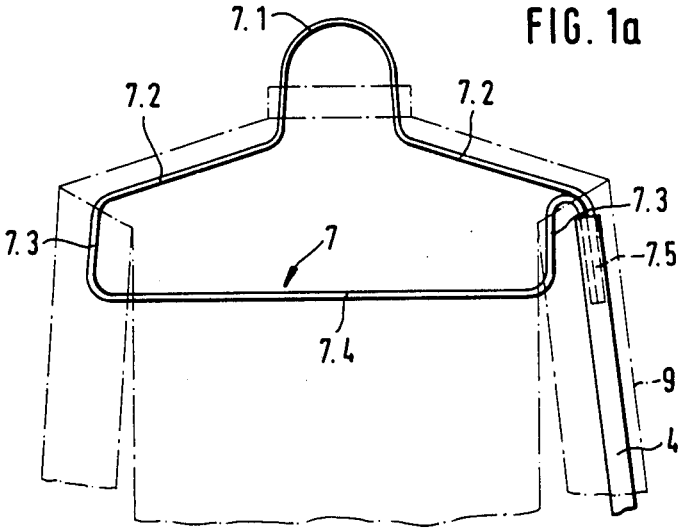
Figure 2:
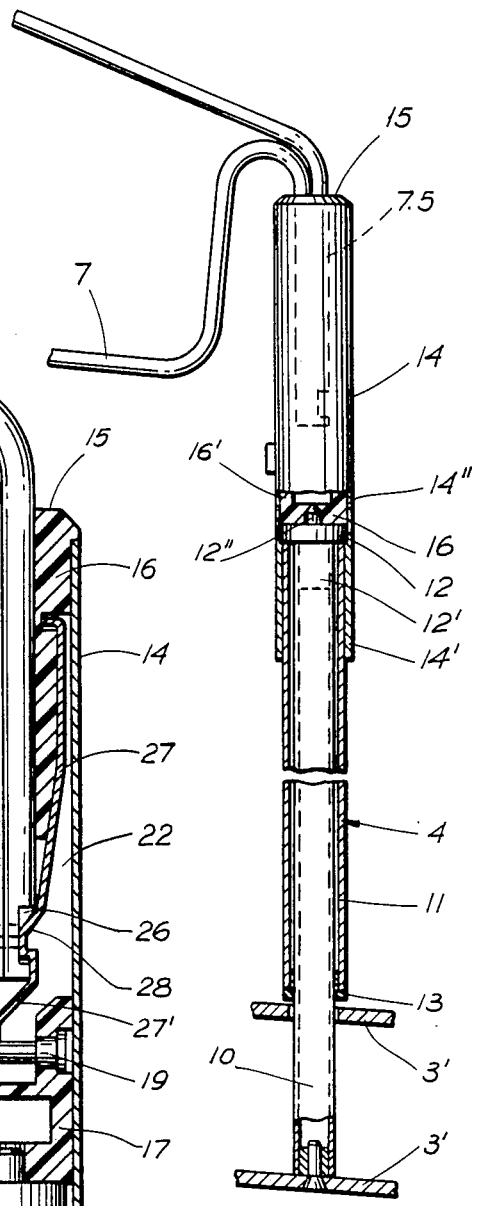
Figure 3:
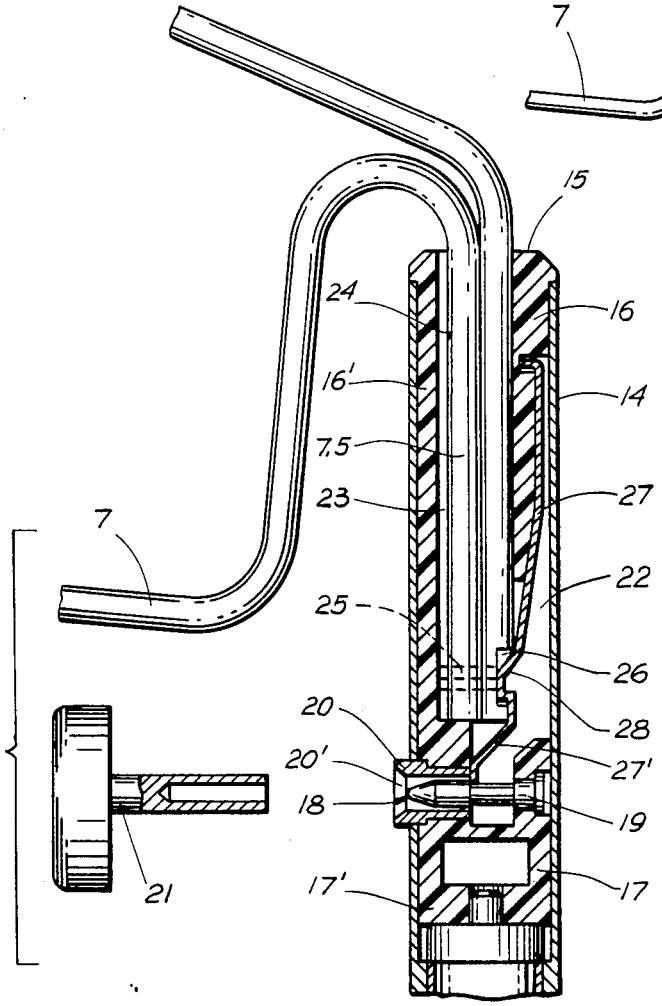

Details of an exemplary embodiment of the invention are described below with reference to the drawing in which:

FIG. 1 shows, in a perspective mode of representation, an embodiment of the clothes-stand according to the invention which is designed as a round stand, FIG. 1*a* shows diagrammatically a clothes-hanger which can be used with the clothes-stand according to FIG. 1, FIG. 2 shows, partially in section, a holding rod of the clothes-stand for receiving a clothes-supporting arm or clothes-hanger so that it is secured, and FIG. 3 shows, in longitudinal section, an embodiment of a locking arrangement at the top end of the holding rod for receiving a clothes-hanger.

The round stand according to FIG. 1 contains on a star-shaped foot 1 a column 2, on which is mounted a supporting arrangement 3 which is rotatable, preferably in the manner of a merry-go-round, and is vertically adjustable. The supporting arrangement 3 carries, appropriately peripherally, a number of holding rods 4 which are mounted on it at approximately equal peripheral distances and which are illustrated on a larger scale in FIGS. 2 and 3. As an axial extension of the column 2, there is provided a central rod 5 which carries at its top end a cross-piece element 6 for the temporary suspension of clothes-hangers 7' and a frame-like sign holder 8.

It goes without saying that the round stand according to FIG. 1 is only one preferred embodiment of the subject of the invention. The supporting structure of the holding rods 4 and their supporting arrangement 3 can, of course, be varied in many ways.

A clothes-supporting element or, more precisely, a clothes-hanger 7, for example of the type shown diagrammatically on a larger scale in FIG. 1*a*, is assigned to each holding rod 4. The clothes-hanger 7 has an essentially symmetrical hanger body with a pronounced neck part 7.1 designed as a suspension member, shoulder parts 7.2 adjoining the latter in each case on the side, lateral vertical spacer pieces 7.3 and an essentially horizontal base rail 7.4. One of the two lateral vertical spacer pieces is extended as a holding member 7.5 to be inserted into a lock attachment 14 of the holding rod 4. This extension is shown in FIGS. 1*a*, 2 and 3 in a preferred alternative design.

The special design of the clothes-hanger 7 is intended not only to ensure a visually attractive presentation of the article of clothing 9 (indicated in FIGS. 1 and 1*a* by broken lines), but also to ensure that a garment placed on it can only be removed from it when the clothes-hanger 7 is lifted off from the holding rod 4.

The holding rod 4 shown in a vertical position in FIG. 2, when located in the clothes-stand according to FIG. 1, is inclined outwards approximately 5° in an oblique position. The purpose of this measure is to generate, on the presentation unit formed from the holding rod 4 and the clothes-hanger 7, a restoring force after the clothes-hanger 7 has been deflected from the radial position relative to the stand column 2. This restoring effect allows a visually pleasing appearance of the stand hung with clothes to be achieved easily.

The holding rod 4 consists essentially of the components described below, which include a base tube 10 screwed with a firm fit in the rotatable and vertically adjustable supporting arrangement 3 (FIG. 1) symbolized by two disk fragments 3'. A casing tube 11 mounted on the base tube 10 rests at its top end against an insert 12, of which a first lower peg 12' engages the base tube 10 with a firm fit. The insert 12 forms a rotary mounting for the casing tube 11 which is pivotable relative to the base tube 10 and which at its bottom end is spaced by means of a guide sleeve 13 from the base tube 10 and centered relative to the latter. A lock attachment 14 surrounded by a metal sleeve rests on the casing tube 11. The metal sleeve is connected firmly to the casing tube 11 in its lower end region 14'. Its upper portion 14'' is arranged so as to rotate freely relative to the insert 12, together with the casing tube 11, and contains a snap-in catch 15 described below with reference to FIG. 3.

The main component of the snap-in catch 15 is a housing block which is appropriately divided in two in the longitudinal direction into two shell members (16, 16') and which on its underside is supported against the insert 12 and is centered on a second upper peg 12''. The shell members 16, 16' of the housing block contain at their inner ends a two-part lock portion 17, 17', the parts of which are formed in one piece on the associated shell part 16 and 16' respectively. Inserted in the lock portion 17, 17' is a blocking unit designated as a whole by 18, which, in the example illustrated, essentially consists of a stud bolt 19 anchored in the lock portion 17 and of a calibrating collar 20 inserted in the lock portion 17'. This calibrating collar passes through the sleeve of the lock attachment 14 and limits an insertion orifice 20' for a key element 21 which serves for releasing an engagement pawl for the holding member 7.5 (see also FIG. 1*a*) on the clothes-hanger 7.

The shell members 16, 16' of the housing block also have a locking bearing 22 formed in the shell member 16 and a guide groove 23 formed in the shell member 16'. Both the locking bearing 22 and the guide groove 23 are adjacent to a central receiving orifice 24 into which the holding member 7.5 of the clothes-hanger is inserted. The theft-proof locking of the holding member 7.5 in the receiving orifice 24 is effected as a result of the interaction of a blocking recess 26 on the holding member 7.5 and a blocking tongue 27 in the form of a flat spring anchored under pre-stress in the shell member 16. The blocking tongue 27 contains a blocking wedge 28 engaging into the blocking recess 26. The end 27' of the blocking tongue 27 located on the same side as the blocking wedge engages the blocking unit 18 or is arranged relative to the stud bolt 19 in such a way that, when the key element 21 is pushed inwards into the blocking unit 18 counter to the spring pre-stress, the locking of the holding element 7.5 in the receiving orifice 24 can be released. To ensure that the holding element 7.5 is inserted into the receiving orifice 24 on the correct side, it is provided in its end portion with a guide pin 25, of which the head projecting beyond the surface of the holding element is intended to engage the guide groove 23.

It is consequently impossible for the clothes-hanger 7 to be inserted into the housing block 16, 16' in the wrong position and for the blocking unit 18 thereby to be rendered ineffective.

The engagement of the blocking wedge 28 into the blocking recess 26 can be made detectable acoustically if the blocking tongue 27 is pre-stressed so that a clearly audible snapping-in noise occurs.

It goes without saying that the means for inserting the clothes-hanger 7 on the correct side into the head of the holding rod 4 or into the blocking insert 15 at the head part of the latter can also be different from the groove/-pin arrangement 23, 25. Likewise, the blocking unit 18 can have a design other than that of a bolt/collar combination 19, 20. And finally, the recess 26, causing the actual locking, and the blocking tongue 27 can also be replaced by other constructional parts which allow automatic engagement of the holding member 7.5 when it is inserted into the housing block 16, 16'. It is essential that it should be impossible for the clothes-hanger 7 to be removed from the holding rod 4 without specially designed unlocking means, such as the key element 21.

I claim:

1. A safety garment stand for presenting articles of clothing in sales rooms and show rooms, comprising a mumber of holding rods (4) made of a jacket tube (11) which are rotatably mounted on a supporting device (1–3), the lower end of the jacket tube being rotatably mounted on a base tube (10) which is firmly connected to the supporting device, and a lock attachment (14) for releasably receiving clothes hangers (7), which are lockable thereon, being provided at the upper end of the jacket tube, said lock attachment (14) including a housing block (16, 16') comprising a central receiving orifice (24) for receiving a holding member (7.5) of said clothes hanger (7) and a releasable snap-in catch (15) for retaining said holding member (7.5) by means of a locking tongue (27) which is lockable from the outside with a key (21).

2. A garment stand as claimed in claim 1, characterized in that said holding member (7.5) of said clothes hanger (7) contains a guide element (25) determining its position of insertion into the central receiving orifice (24) of said housing block (16, 16') and a recess (26) for engaging the free end of said locking tongue (27) in its locking position into said holding member (7.5).

3. A garment stand as claimed in claim 2, characterized in that said housing block consists of two longitudinally divided shell members (16 16'), said locking tongue (27) being disposed in one shell member (16) and the other shell member (16') containing a guide groove (23) in which the guide element (25) is held so as to be longitudinally displaceable.

4. A garment stand as claimed in claim 3 characterized in that said locking tongue (27) is formed as a spring member and is anchored under pre-stress in the respective shell member (16).

5. A garment stand as claimed in claim 4, characterized in that said locking tongue (27) is provided in a first area of its free end with a first deflection (28) engaging into said recess (26) of the holding member (7.5) of said clothes hanger, and in a second area it is provided with a second deflection (27') for releasing the engagement of the first deflection (28) into said recess (26) of said holding member (7.5).

* * * * *